US005232492A

United States Patent [19]

Krulik et al.

[11] Patent Number: 5,232,492

[45] Date of Patent: Aug. 3, 1993

[54] ELECTROLESS GOLD PLATING COMPOSITION

[75] Inventors: Gerald A. Krulik, El Toro, Calif.; Nenad V. Mandich, Homewood, Ill.

[73] Assignee: Applied Electroless Concepts Inc., El Toro, Calif.

[21] Appl. No.: 824,076

[22] Filed: Jan. 23, 1992

[51] Int. Cl.[5] ..... C23C 18/16; C23C 18/44

[52] U.S. Cl. ..... 106/1.23; 106/1.26

[58] Field of Search ..... 427/304, 306, 437, 443.1; 106/1.05-1.29

[56] References Cited

U.S. PATENT DOCUMENTS 5,106,413 4/1992 Takehawa ..... 106/1.22

*Primary Examiner*—Mark L. Bell
*Assistant Examiner*—Margaret Einsmann
*Attorney, Agent, or Firm*—Lawrence I. Field

[57] ABSTRACT

An electroless gold plating solution comprising a gold(I) complex, a thiosulfate, a sulfite, a pH regulator and an oxidation controller. The electroless gold plating solution uses a novel reducing agent system, the thiosulfate-sulfite-sulfate system. It shows a plating rate and a plating solution stability comparable to those of conventional gold plating solutions containing borohydride, thiourea, hydrazine, and other reducing agents.

8 Claims, No Drawings

ELECTROLESS GOLD PLATING COMPOSITION

BACKGROUND OF THE INVENTION

The present invention relates to an electroless gold plating solution, and more particularly, to a gold plating solution which uses a novel reducing agent system which is low in toxicity and very stable.

Many types of reducing agents have been used, as reviewed in *Gold Bulletin* 8 p.119–126 (1975). These have included hypophosphite, hydrazine, diethylglycine, ammonia, thiourea, borohydride, formaldehyde, dimethylamine borane, aldehyde-amine borane, unstable organogold compounds, and others. None of these baths are truly stable or commercially useful on a large scale. Most have very short effective plating lives, often in the range of hours or a few days.

Most of the most useful commercial electroless gold plating solutions contain cyanide either as a stabilizer, a main complexing agent, or both. The U.S. Pat. No. 4,863,766 is typical, in using a gold cyanide complex, another cyanide compound, and hydrazine as the reducing agent. Another bath has been disclosed which contains gold(I) potassium cyanide, potassium cyanide and a borane compound as main constituents, as disclosed in *Plating*, 57 (1970), pp. 914–920. This plating solution is said to allow a plating rate of 1 micrometer/hr with some stability. However, since these plating solutions contains a large amount of cyanide ions, there is a safety problem in operation of the solutions and in disposal of waste baths, rinses, and dragout.

An electroless gold plating solution not containing cyanide ions, using gold(III) chloride and hydrazine as main constituents is disclosed in U.S. Pat. No. 3,300,328. When trivalent gold ions are used, the solutions require a larger amount of reducing agent, as compared to the case of using gold(I) potassium cyanide. In addition, the electroless gold plating solution disclosed in U.S. Pat. No. 3,300,328 is so unstable that general gold precipitation occurs in the plating solution in about 2 hours, making it impossible to continue plating.

An electroless plating bath which does not use cyanide is disclosed in U.S. Pat. No. 4,880,464. They state that the purpose of the use of a large amount of cyanide ions in a conventional electroless gold plating solution is to form stable gold complex ions, and thus control the rate of precipitation of gold where a plating solution is used with a strong reducing agent. They presumed that thiosulfate ions are suitable for use as a complexing agent in place of cyanide ions. Based on the presumption, an electroless gold plating solution was prepared by selecting thiourea as a reducing agent having a strong reducing power in a neutral aqueous solution, using a thiosulfate gold(I) complex, e.g., gold(I) sodium thiosulfate as a complexing agent, and adding a stabilizer. They found that the thiourea reducing agent gave a plating rate and a plating solution stability comparable to those of conventional plating solutions containing cyanide ions and borohydride or other strong reducing agents. However, the stability, plating rate, and appearance of these solutions are much inferior to those of the present invention. Thiourea is not an ideal reducing agent, as it is a proven carcinogenic agent in laboratory animals.

SUMMARY OF THE INVENTION

An object of the present invention is to provide an electroless gold plating solution which uses a novel reducing agent system. This system comprises the redox system thiosulfate-sulfite-sulfate. No other reducing agent is needed. The need for any additional type of reducing agent, such as thiourea, hydrazine, or boron hydrides, has been eliminated. The bath does not contain cyanide ions as a plating liquid constituent, requires only a small amount of the sulfite reducing agent since the gold is present as monovalent gold complexes, and has a plating rate and a plating solution stability far greater than any previously known electroless gold bath. The bath is a true electroless gold plating bath, not an immersion bath, since the gold thickness continues to increase with time in a fashion typical of electroless nickel and electroless copper baths.

The electroless gold plating solution according to the present may be prepared from any convenient cyanide-free, soluble gold solution of gold(III) or gold(I) salt. Typical gold sources are chloroauric acid and gold(I) sulfite. The gold(I) sulfite may be prepared from sulfite, bisulfite, or metabisulfite salts as convenient. Alternatively, the soluble gold source may be a gold thiosulfate complex. Regardless of the exact gold source used initially, the final electroless plating solution will contain a mixture of both gold thiosulfate and gold sulfite complexes.

The above-mentioned object can be attained by providing an electroless gold plating solution which comprises water, a gold(I) complex, a thiosulfate, a sulfite, a pH regulator, and an oxidation controller. The content of gold (I) complex is 0.005 to 0.3 moles per liter, the content of thiosulfate is 0.01 to 1 mole per liter and the content of sulfite is 0.001 to 0.5 moles per liter. The gold (I) concentration is between 0.5 and 50 g/l and is preferably between 1.5 and 15 g/l. The ratio of thiosulfate to gold (I) complex is from 1/1 to 400/1 and preferably from 2/1 to 40/1 and the ratio of thiosulfate to sulfite is from 1/50 to 400/1 and preferable from 1/10 to 200/1. The solution of pH is 6 to 11.0 and the operating temperature of the bath is 35° C. to 95° C. While not wishing to be bound by theory, the solution seems to work in the following manner. The initial gold complex of chloroauric acid is stabilized by the addition of sulfite or metabisulfite. Such sulfite gold solutions are well-known and commercially available. The sulfite gold solutions are also known to be extremely unstable. They are used for electrolytic plating in special non-cyanide processes.

Sulfite solutions oxidize readily to sulfate in the presence of air or other mild oxidizing agents. Contaminants such as copper or nickel ions increase the rate of oxidation of sulfite, and thus decrease the bath stability. An oxidation rate controller can be used to reduce the effect of such contaminants. Useful non-cyanide oxidation rate controllers include typical strong chelating agents such as EDTA (ethylenediaminetetraacetic acid) and NTA (nitrilotriacetic acid). However, the incorporation of oxidation rate controllers alone into a gold sulfite bath does not make the bath stable, nor does it make the bath an electroless plating bath.

It has been discovered that the addition of another sulfur compound, thiosulfate, dramatically changes the character and stability of a sulfite gold electroplating bath. When controlled at the proper temperature and pH, the solution becomes an effective electroless gold plating bath which gives constant plating rates over an indefinite period. This electroless gold bath has a demonstrated bath life under heavy use conditions of many months, with more then ten complete gold replenishment cycles. The plating rate can be varied over a wide range without drastically affecting the stability.

The process is hypothesized to work due to the mutually interactive effects of the sulfite and thiosulfate. Sulfite and thiosulfate can interconvert freely to each other under the proper conditions. The thiosulfate may increase the stability of the initial gold sulfite complex by also forming gold thiosulfate complexes. The thiosulfate may also function as an effective sink and source for sulfite, which is thought to be the main reducing agent. As previously stated, baths containing only sulfite are very unstable and do not give effective electroless plating solutions. Baths containing only thiosulfate are also ineffective as plating Only baths containing both components show electroless plating behavior and high bath stability without the use of any additional reducing agents. This stability is enhanced by use of oxidation rate controllers and operation at controlled pH.

The following descriptions (a) to (f) cover the limitations on the amounts of the constituents of the electroless gold plating solution according to the present invention, and the grounds for the limitations.

(a) The content of the gold as gold(I) complexes is suitable from 0.5 to 50 grams of gold per liter and most preferably from 1.5 to 15 g/l. If the concentration of the gold is too low, the plating reaction is very slow and extraneous metals such as copper and nickel may be incorporated into the deposit. If the gold concentration is too high, it is difficult to control the plating rate and uncontrolled plating may occur on the container and unwanted areas of the plating surface.

(b) The total amount of thiosulfate used in the bath may vary from about 1 g/l to saturation at operating temperature. The more preferred range is from about 10 to about 400 g/l, and the most preferred range is from about 15 g/l to about 200 g/l.

(c) The content of sulfite used in the bath may vary from about 0.001 g/l to about 200 g/l at operating temperature. The more preferred range is from about 0.01 to about 50 g/l, and the most preferred range is from about 0.1 to about 20 g/l.

(d) The oxidation rate controller used in the bath may vary from about 0.001 g/l to about 50 g/l. The most preferred range is from about 0.1 g/l to about 10 g/l.

The pH value of the plating solution is from 6–11, most preferably from 6.5–9. The solution temperature is from 35 to 95 degrees C, most preferably from 55 to 75 degrees C.

DETAILED DESCRIPTION OF THE PREFERRED EMBODIMENTS

The present invention will be described more in detail referring to the following examples. The present invention of gold will not plate directly upon copper, the copper being rapidly dissolved without allowing a gold layer to form. Electroless gold will plate directly upon electroless nickel and electrolytic nickel, so all test pieces were copper clad printed circuit boards coated with electroless nickel. In order to improve adhesion of the electroless gold and to provide proof of the electroless character of the claimed electroless gold bath, a standard commercial cyanide gold immersion bath was used to provide an initial 0.025–0.05 micrometers of gold on the electroless nickel surface. However, this immersion gold bath was used merely as an additional step of convenience and is not an integral or necessary part of the electroless gold plating process. The immersion gold coating serves to coat the electroless nickel surface with a continuous gold coating, thus showing that the electroless gold bath claimed here is a true electroless bath. Many so-called electroless baths are merely immersion baths which function by dissolving the pre-existing surface and replacing it with another metal from solution. A true electroless bath will plate on a continuous surface of a catalytic metal which does not dissolve, in this case a pre-existing immersion gold coating.

Although the disclosure hereof is detailed and exact, the formulations listed in the examples are merely illustrative of the useful catalyst formulations. Any formulator skilled in the art can utilize these examples and this concept to prepare many workable solutions in addition to those shown in the examples.

Test articles were one ounce per square foot copper foil clad epoxy glass laminate printed circuit board material. These boards were cut into 2.5 cm by 7.5 cm sections for convenience of use. The cleaner was ACI Cleaner C-10. The microetchant was ACI Microetch E-20. The activator was ACI Activator A-40. All ACI products are proprietary products from Austral Calae International. The electroless nickel solution used was Niposit 65 (Shipley Company). The immersion gold solution was Lectroless Prep (Enthone-OMI-Selrex). The autocatalytic electroless gold formulations used are given in the examples.

EXAMPLES 1–5.

Test panels were copper-clad double sided printed circuit boards 2.5 by 7.5 cm pieces. Test panels were all given a standard process cycle before electroless gold plating. This cycle is given in Table I. Rinses are understood between each process step.

TABLE I

| | |
|---|---|
| Clean | ACI Cleaner C-10; 1 min; 45 C. |
| Microetch | ACI Microetch E-20; 1 min, 35 C. |
| Acid Dip | Sulfuric acid, 10%; 0.5 min, room temperature. |
| Pre Dip | ACI Predip D-30; 0.5 min, room temperature. |
| Catalyst | ACI Activator A-40; 1 min, 45 C. |
| Electroless nickel | Niposit 65; 20 min, 90 C. |
| Immersion gold | Lectroless Prep; 1 min, 90 C. |
| Electroless gold | Per examples |

EXAMPLE 1

The gold solution consisted of a solution of 200 g/l sodium thiosulfate, 20 g/l of sodium sulfite, 0.1 g/l of disodium EDTA, and 3 g/l of gold as a gold(I) complex. The pH was adjusted to pH 7.5 and the solution heated to 65 C. The gold thickness was 7 millionths of an inch after 15 minutes.

EXAMPLE 2

The gold solution consisted of a solution of 200 g/l sodium thiosulfate, 1 g/l of sodium sulfite, 0.1 g/l of disodium EDTA, and 3 g/l of gold as a gold(I) complex. The pH was adjusted to pH 7.5 and the solution heated to 65 C. The gold thickness was 2 millionths of an inch after 15 minutes.

EXAMPLE 3

The gold solution consisted of a solution of 10 g/l sodium thiosulfate, 2 g/l of sodium sulfite, 0.1 g/l of disodium EDTA, and 3 g/l of gold as a gold(I) complex. The pH was adjusted to pH 8.5 and the solution heated to 80 C. The gold thickness was 1.5 millionths of an inch after 15 minutes.

EXAMPLE 4

The gold solution consisted of a solution of 5 g/l sodium thiosulfate, 50 g/l of sodium sulfite, 0.1 g/l disodium EDTA, and 3 g/l of gold as a gold(I) complex. The pH was adjusted to pH 8.0 and the solution heated to 50 C. The gold thickness was 1.6 millionths of an inch after 15 minutes.

EXAMPLE 5

The gold solution consisted of a solution of 20 g/l sodium thiosulfate, 20 g/l of sodium sulfite, 0.1 g/l disodium EDTA, and 6 g/l of gold as a gold(I) complex. The pH was adjusted to pH 8.5 and the solution heated to 60 C. The gold thickness was 2.2 millionths of an inch after 15 minutes.

EXAMPLE 6

The gold solution consisted of a solution of 30 g/l sodium thiosulfate, 20 g/l of sodium sulfite, 0.1 g/l disodium EDTA, and 1 g/l of gold as a gold(I) complex. The pH was adjusted to pH 10.0 and the solution heated to 90 C. The gold thickness was 12 millionths of an inch after 15 minutes.

EXAMPLE 7

The gold solution consisted of a solution of 100 g/l sodium thiosulfate, 5 g/l of sodium sulfite, 0.1 g/l disodium EDTA, and 10 g/l of gold as a gold(I) complex. The pH was adjusted to pH 8.0 and the solution heated to 40 C. The gold thickness was 1.2 millionths of an inch after 15 minutes.

EXAMPLE 8

The gold solution consisted of a solution of 10 g/l sodium thiosulfate, 0.2 g/l of sodium sulfite, 0.1 g/l disodium EDTA, and 3 g/l of gold as a gold(I) complex. The pH was adjusted to pH 7.5 and the solution heated to 60 C. The gold thickness was 1.4 millionths after 15 minutes.

What is claimed is:

1. An electroless gold plating solution consisting essentially of water, a non-cyanide gold (I) complex selected from the group consisting of a gold sulfite, a gold thiosulfate and mixtures of both, a thiosulfate, a sulfite, and a chelating agent, said solution having a pH adjusted to between 6 and 11.

2. An electroless gold plating solution according to claim 1, wherein said gold(I) concentration is between 0.5 and 60 g/l.

3. An electroless gold plating solution according to claim 1, wherein said gold(I) concentration is between 1.5 and 15 g/l.

4. An electroless gold plating solution according to claim 1, wherein the ratio of thiosulfate to gold is from 1/1 to 400/1.

5. An electroless gold plating solution according to claim 1, wherein the ratio of thiosulfate to gold(I) is from 2/1 to 40/1.

6. An electroless gold plating solution according to claim 1, wherein the ratio of thiosulfate to sulfite is from 1/50 to 400/1.

7. An electroless gold plating solution according to claim 1, wherein the ratio of thiosulfate to sulfite is from 1/10 to 200/1.

8. An electroless gold plating solution according to claim 1, wherein the content of gold(I) complex is 0.0025 to 0.3 moles per liter, the content of the free thiosulfate is 0.01 to 1 moles per liter, and the content of sulfite is 0.001 to 0.5 moles per liter.

* * * * *